US010989486B2

(12) United States Patent
Hedberg

(10) Patent No.: US 10,989,486 B2
(45) Date of Patent: Apr. 27, 2021

(54) HEAT TRANSFER PLATE AND PLATE HEAT EXCHANGER COMPRISING A PLURALITY OF SUCH HEAT TRANSFER PLATES

(71) Applicant: ALFA LAVAL CORPORATE AB, Lund (SE)

(72) Inventor: Magnus Hedberg, Hjärup (SE)

(73) Assignee: ALFA LAVAL CORPORATE AB, Lund (SE)

( * ) Notice: Subject to any disclaimer, the term of this patent is extended or adjusted under 35 U.S.C. 154(b) by 156 days.

(21) Appl. No.: 16/078,868

(22) PCT Filed: Mar. 20, 2017

(86) PCT No.: PCT/EP2017/056532
§ 371 (c)(1),
(2) Date: Aug. 22, 2018

(87) PCT Pub. No.: WO2017/167598
PCT Pub. Date: Oct. 5, 2017

(65) Prior Publication Data

US 2019/0204024 A1 Jul. 4, 2019

(30) Foreign Application Priority Data

Mar. 30, 2016 (EP) ..... 16162907

(51) Int. Cl.
*F28F 3/04* (2006.01)
*F28D 9/00* (2006.01)

(52) U.S. Cl.
CPC ..... *F28F 3/046* (2013.01); *F28D 9/005* (2013.01); *F28F 3/04* (2013.01)

(58) Field of Classification Search
CPC ..... F28F 3/04; F28F 3/046; F28D 9/005
(Continued)

(56) References Cited

U.S. PATENT DOCUMENTS 2,699,324 A * 1/1955 Goodman ..... F28F 3/083 165/167
3,228,464 A * 1/1966 Stein ..... F28D 9/0012 165/166

(Continued)

FOREIGN PATENT DOCUMENTS

AT 393 162 B 8/1991
CN 2097998 U 3/1992

(Continued)

OTHER PUBLICATIONS

Behr GMBH (DE102008014375) english translation Sep. 24, 2009.*

(Continued)

*Primary Examiner* — Joel M Attey
(74) *Attorney, Agent, or Firm* — Buchanan Ingersoll & Rooney PC

(57) ABSTRACT

A heat transfer plate and a heat exchanger comprising a plurality of such heat transfer plates are provided. The heat transfer plate comprises a heat transfer pattern of alternately arranged ridges and valleys. First and second adjacent ridges extend obliquely in relation to a longitudinal centre axis of the plate and comprise a first top portion and a second top portion, respectively, and first and second adjacent valleys extend obliquely in relation to the longitudinal centre axis and comprise a first bottom portion and a second bottom portion, respectively. The first bottom portion of the first valley is connected to the first top portion of the first ridge by a first flank and to the second top portion of the second ridge by a second flank, and the second top portion of the second ridge is connected to the second bottom portion of the second valley by a third flank.

20 Claims, 4 Drawing Sheets

(58) Field of Classification Search
USPC ..... 165/166
See application file for complete search history.

(56) References Cited

U.S. PATENT DOCUMENTS

| | | | |
|---|---|---|---|
| 3,229,763 | A | 1/1966 | Rosenblad |
| 3,807,496 | A | 4/1974 | Stadmark |
| 3,809,156 | A | 5/1974 | Andersson |
| 3,931,854 | A | 1/1976 | Ivakhnenko et al. |
| 5,522,462 | A | 6/1996 | Kumar et al. |
| 5,806,584 | A | 9/1998 | Thonon et al. |
| 2013/0126135 | A1 | 5/2013 | Romlund |
| 2013/0180699 | A1 | 7/2013 | Dahlberg |

FOREIGN PATENT DOCUMENTS

| | | | |
|---|---|---|---|
| CN | 201129948 | Y | 10/2008 |
| CN | 100513968 | C | 7/2009 |
| CN | 102985780 | A | 3/2013 |
| CN | 104359337 | A | 2/2015 |
| CN | 105371684 | A | 3/2016 |
| CN | 105387741 | A | 3/2016 |
| CN | 205300327 | U | 6/2016 |
| CN | 205300358 | U | 6/2016 |
| DE | 202007012261 | U1 | 11/2007 |
| DE | 102008014375 | A1 | 9/2009 |
| EP | 2 169 338 | A1 | 3/2010 |
| EP | 2 886 997 | A1 | 6/2015 |
| GB | 1071116 | A | 6/1967 |
| JP | H08-094276 | A | 4/1996 |
| JP | 2000193390 | A | 7/2000 |
| JP | 2013-530374 | A | 7/2013 |
| SU | 1 829 559 | A1 | 2/1996 |
| WO | 2009123519 | A1 | 10/2009 |
| WO | 2012004100 | A1 | 1/2012 |

OTHER PUBLICATIONS

Office Action (First Office Action) dated Aug. 28, 2019, by the National Intellectual Property Administration, P.R. China in corresponding Chinese Patent Application No. 201780021342.3 and an English Translation of the Office Action. (13 pages).

Office Action (Notice of Reasons for Rejection) dated Oct. 28, 2019, by the Japanese Patent Office in corresponding Japanese Patent Application No. 2018-551791 and an English Translation of the Office Action. (10 pages).

N.V. Baranovsky et al., "Plate and spiral heat exchangers", M:, Mechanical Engineering, (1973, month unknown), pp. 67-69.

An English Translation of the Office Action dated Jul. 10, 2019, by the Russian Patent Office in corresponding Russian Patent Application No. 2018138010/06(063029). (7 pages).

International Search Report (PCT/ISA/210) dated Apr. 13, 2017, by the European Patent Office as the International Searching Authority for International Application No. PCT/EP2017/056532.

Written Opinion (PCT/ISA/237) dated Apr. 13, 2017, by the European Patent Office as the International Searching Authority for International Application No. PCT/EP2017/056532.

Office Action dated Jun. 29, 2020, by the Intellectual Property India in corresponding India Patent Application No. 201817034224 and an English Translation of the Office Action. (6 pages).

Office Action (Notification of Reason for Refusal) dated Jun. 26, 2020, by the Korean Intellectual Property Office in corresponding Korean Patent Application No. 10-2020-7013820 and an English Translation of the Office Action. (11 pages).

Japanese Office Action dated Jan. 12, 2021 issued by the Japanese Patent Office in corresponding Japanese Patent Application No. 2018-551791, with English translation (12 pages).

* cited by examiner

HEAT TRANSFER PLATE AND PLATE HEAT EXCHANGER COMPRISING A PLURALITY OF SUCH HEAT TRANSFER PLATES

TECHNICAL FIELD

The invention relates to a heat transfer plate and its design. The invention also relates to a plate heat exchanger comprising a plurality of such heat transfer plates.

BACKGROUND ART

Plate heat exchangers, PHEs, typically consist of two end plates in between which a number of heat transfer plates are arranged in an aligned manner, i.e. in a stack or pack. Parallel flow channels are formed between the heat transfer plates, one channel between each pair of heat transfer plates. Two fluids of initially different temperatures can flow through every second channel for transferring heat from one fluid to the other, which fluids enter and exit the channels through inlet and outlet port holes in the heat transfer plates.

Typically, a heat transfer plate comprises two end areas and an intermediate heat transfer area. The end areas comprise the inlet and outlet port holes and a distribution area pressed with a distribution pattern of projections and depressions, such as ridges and valleys, in relation to a central extension plane of the heat transfer plate. Similarly, the heat transfer area is pressed with a heat transfer pattern of projections and depressions, such as ridges and valleys, in relation to said central extension plane. In a plate heat exchanger, the ridges and valleys of the distribution and heat transfer patterns of one heat transfer plate may be arranged to contact, in contact areas, ridges and valleys of distribution and heat transfer patterns of adjacent heat transfer plates.

The main task of the distribution area of the heat transfer plates is to spread a fluid entering the channel across a width of the heat transfer plate before the fluid reaches the heat transfer area, and to collect the fluid and guide it out of the channel after it has passed the heat transfer area. On the contrary, the main task of the heat transfer area is heat transfer. Since the distribution area and the heat transfer area have different main tasks, the distribution pattern normally differs from the heat transfer pattern. The distribution pattern may be such that it offers a relatively weak flow resistance and low pressure drop which is typically associated with a more "open" pattern design, such as a so-called chocolate pattern, offering relatively few, but large, contact areas between adjacent heat transfer plates. The heat transfer pattern may be such that it offers a relatively strong flow resistance and high pressure drop which is typically associated with a more "dense" pattern design, such as a so-called herringbone pattern, illustrated schematically in cross section in FIG. 3, offering more, but smaller, contact areas between adjacent heat transfer plates. Even if the known heat transfer patterns offer a far more effective heat transfer than the known distribution patterns, there is still room for improvement.

SUMMARY

An object of the present invention is to provide a heat transfer plate which, when comprised in a heat exchanger, enables a more effective heat transfer between the fluids than known heat transfer plates. The basic concept of the invention is to provide the heat transfer plate with an asymmetric heat transfer pattern in relation to the central extension plane. Another object of the present invention is to provide a heat exchanger comprising a plurality of such heat transfer plates. The heat transfer plate and the heat exchanger for achieving the objects above are defined in the appended claims and discussed below.

A heat transfer plate according to the present invention has a longitudinal centre axis and defines or extends in a top plane, a bottom plane and a central extension plane extending half way between, and parallel to, the longitudinal centre axis and the top and bottom planes. As is clear from the names, the top and bottom planes delimit the heat transfer plate, i.e. the heat transfer plate extends completely in and between, but not beyond, the top and bottom planes. The heat transfer plate comprises a heat transfer area comprising a heat transfer pattern of alternately arranged ridges and valleys in relation to the central extension plane. First and second adjacent ones of the ridges extend obliquely in relation to the longitudinal centre axis of the heat transfer plate and comprise a first top portion and a second top portion, respectively, and first and second adjacent ones of the valleys extend obliquely in relation to the longitudinal centre axis of the heat transfer plate and comprise a first bottom portion and a second bottom portion, respectively. Thus, there is an angle≠0 between the longitudinal centre axis of the heat transfer plate and an extension of each of the first and second ridges and valleys. The first and second ridges and valleys may, but does not have to, be parallel and/or straight, i.e. have a linear extension. The first valley is arranged between the first and second ridges and the second ridge is arranged between the first and second valleys. The first bottom portion of the first valley is connected to the first top portion of the first ridge by a first flank and to the second top portion of the second ridge by a second flank. The second top portion of the second ridge is connected to the second bottom portion of the second valley by a third flank. The first and second top portions extend in the top plane, and the first and second bottom portions extend in the bottom plane. The heat transfer plate is characterized in that one of the first, second and third flanks comprise a flank shoulder. The flank shoulder is arranged at, or extends in, a flank shoulder plane which is displaced from the central extension plan. With reference to a cross section through, and perpendicular to a longitudinal extension of, the first and second ridges and the first and second valleys, a first area defined or enclosed by the heat transfer plate and a first shortest imaginary straight line extending from the first to the second top portion of the first ridge and the second ridge, respectively, is different from a second area defined or enclosed by the heat transfer plate and a second shortest imaginary straight line extending from the first to the second bottom portion of the first valley and the second valley, respectively.

Thus, at least one of the first, second and third flanks is provided with a shoulder. However, the heat transfer plate may be such that the first, second and third flanks comprise a first shoulder, a second shoulder and a third shoulder, respectively, arranged at, or extending in, a first, second and third shoulder plane, respectively. Then, each of the first, second and third flanks is provided with a respective shoulder and the above mentioned flank shoulder and flank shoulder plane is in fact one of the first, second and third shoulders and the corresponding one of the first, second and third shoulder planes.

Naturally, the top, bottom and central extension planes are imaginary.

By the expression that a shoulder is arranged at, or extends in, a shoulder plane is meant that a centre point of the shoulder is arranged in the shoulder plane.

By ridge is meant an elongate continuous elevation that extends, with reference to a longitudinal centre axis of the heat transfer plate, obliquely across the complete, or a portion of the, heat transfer area. Similarly, by valley is meant an elongate continuous trench that extends, with reference to the longitudinal centre axis of the heat transfer plate, obliquely across the complete, or a portion of the, heat transfer area. The ridges and valleys extend along each other and they both typically have a continuous cross section along essentially their complete lengths. Accordingly, also the flanks and their shoulders, which could also be referred to as ledges or plateaus, are elongate. The shoulders may extend along essentially the complete lengths of the flanks and they may have a continuous cross section along essentially their complete lengths.

The heat transfer pattern is asymmetric as seen two-dimensionally in that the first area delimited by a front side of the heat transfer plate differs from the second area delimited by a back side of the heat transfer plate. Naturally, the heat transfer pattern is asymmetric as seen also three-dimensionally in that a first volume enclosed by the front side of the heat transfer plate and the top plane differs from a second volume enclosed by the back side of the heat transfer plate and the bottom plane. When the heat transfer plate is installed in a heat exchanger, this asymmetric pattern, and more particularly the shoulder(s) of the flank(s), provide(s) for increased flow turbulence in the channels of the heat exchanger. Further, the shoulder(s) of the flank(s) result(s) in a surface enlargement of the heat transfer plate and thus a larger heat transfer area. Increased flow turbulence and increased heat transfer area provide for a more efficient heat transfer between the fluids flowing through the heat exchanger.

The first, second and third shoulder planes may all be displaced from the central extension plane. Further, the first, second and third shoulder planes may coincide meaning that the first, second and third shoulders are similarly positioned on the first, second and third flanks, respectively. These embodiments may provide for plate symmetry which in turn may provide for an even strength of a plate pack containing the heat transfer plate.

The first, second and third shoulder planes may extend between the bottom plane and the central extension plane. Such an embodiment is associated with a larger first area and a smaller second area and it may contribute to the asymmetry of the heat transfer pattern. The closer the first, second and third shoulder planes are to the bottom plane, the larger the first area is and the smaller the second area is.

The heat transfer plate may be such that the first, second and third flanks comprise one respective shoulder only which may make the heat transfer plate stronger than if the flanks had comprised more than one respective shoulder each.

The heat transfer plate may be such that, with reference to said cross section, the first and second ridges are uniform and/or the first and second valleys are uniform. Further, with reference to said cross section, the first and third flanks may be uniform and the second flank may be a mirroring of the first and third flanks. These embodiments may provide for plate symmetry which in turn may provide for an even strength of a plate pack containing the heat transfer plate.

With reference to said cross section, the first and second ridges may each have a symmetry axis extending perpendicularly to the top plane and through a respective centre of the first and second top portions, respectively. Similarly, with reference to said cross section, the first and second valleys may each have a symmetry axis extending perpendicularly to the bottom plane and through a respective centre of the first and second bottom portions, respectively.

The heat transfer plate may be such that the first valley is wider than the first ridge. Also, the heat transfer plate may be such that the first and second valleys are wider than the first and second ridges. Wider first and second valleys are associated with a larger first area and a smaller second area and may contribute to the asymmetry of the heat transfer pattern.

A heat exchanger according to the present invention comprises a plurality of heat transfer plates according to the present invention. A front side of a first one of the heat transfer plates faces a back side of a second one of the heat transfer plates. Further, a front side of the second heat transfer plate faces a back side of a third one of the heat transfer plates. The second heat transfer plate is rotated 180 degrees in relation to the first and third heat transfer plates around a centre axis of the second heat transfer plate extending through a centre, and perpendicularly to the central extension plane, of the second heat transfer plate. Thus, every second heat transfer plate is rotated 180 degrees in its central extension plane so as to be turned up-side-down with respect to a reference orientation.

In the above heat exchanger the valleys of the heat transfer pattern of the second heat transfer plate may abut the ridges of the heat transfer pattern of the first heat transfer plate to define a first channel. Further, the ridges of the heat transfer pattern of the second heat transfer plate may abut the valleys of the heat transfer pattern of the third heat transfer plate to define a second channel. Here, the first and second channels have the same volume.

In an alternative heat exchanger according to the present invention, which comprises a plurality of heat transfer plates according to the present invention, a back side of a first one of the heat transfer plates faces a back side of a second one of the heat transfer plates. Further, a front side of the second heat transfer plate faces a front side of a third one of the heat transfer plates. The second heat transfer plate is rotated 180 degrees in relation to the first and third heat transfer plates around a centre axis of the second heat transfer plate extending through a centre, and perpendicularly to the central extension plane, of the second heat transfer plate. Thus, every second heat transfer plate is rotated 180 degrees around a transverse centre axis thereof so as to be flipped with respect to a reference orientation.

In the above heat exchanger the valleys of the heat transfer pattern of the second heat transfer plate may abut the valleys of the heat transfer patter of the first heat transfer plate to define a first channel. Further, the ridges of the heat transfer pattern of the second heat transfer plate may abut the ridges of the heat transfer pattern of the third heat transfer plate to define a second channel. Here, the first and second channels have different volumes.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
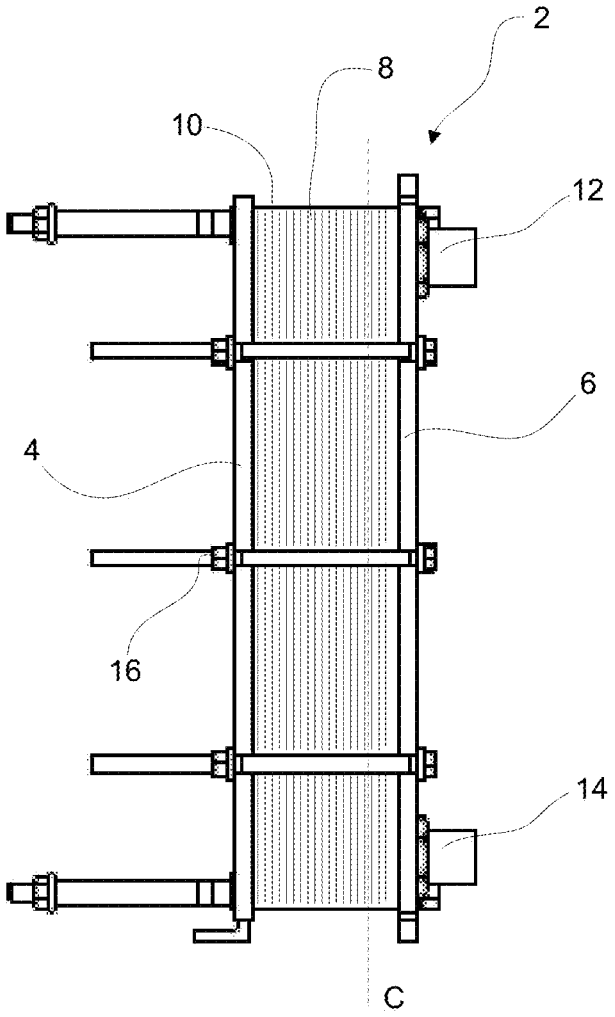
FIG. 1 is a side view of a heat exchanger according to the invention.

With reference to FIG. 1, a gasketed plate heat exchanger 2 is shown. It comprises a first end plate 4, a second end plate 6 and a number of heat transfer plates 8 arranged in a plate pack 10 between the first and second end plates 4 and 6, respectively. The heat transfer plates are all of the type illustrated in FIGS. 2 and 4.

The heat transfer plates 8 are separated from each other by gaskets (not shown). The heat transfer plates together with the gaskets form parallel channels arranged to alternately receive two fluids for transferring heat from one fluid to the other. To this end, a first fluid is arranged to flow in every second channel and a second fluid is arranged to flow in the remaining channels. The first fluid enters and exits the plate heat exchanger 2 through an inlet 12 and an outlet 14, respectively. Similarly, the second fluid enters and exits the plate heat exchanger 2 through an inlet and an outlet (not visible in the figures), respectively. For the channels to be leak proof, the heat transfer plates must be pressed against each other whereby the gaskets seal between the heat transfer plates 8. To this end, the plate heat exchanger 2 comprises a number of tightening means 16 arranged to press the first and second end plates 4 and 6, respectively, towards each other.

The design and function of gasketed plate heat exchangers are well-known and will not be described in detail herein.

Figure 2:
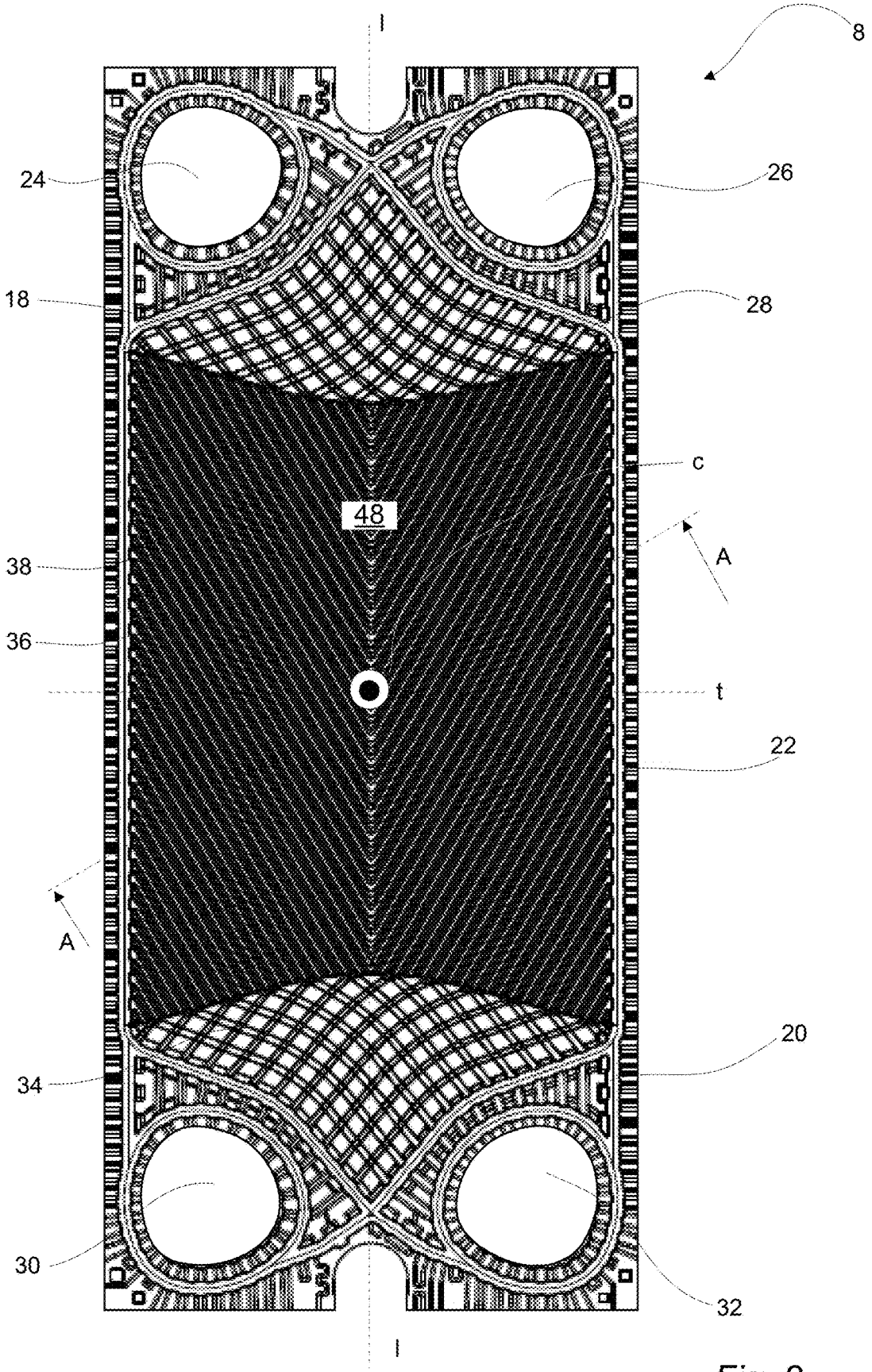
FIG. 2 is a plan view of a heat transfer plate according to the invention, FIG. 3 schematically illustrates a cross section of a known heat transfer pattern, FIG. 4 schematically illustrates a part of a cross section of the heat transfer plate of FIG. 2, taken along line A-A, FIG. 5 schematically illustrates channels formed between heat transfer plates according to the invention when stacked in a first way, and FIG. 6 schematically illustrates channels formed between heat transfer plates according to the invention when stacked in a second way.
Figure 3:
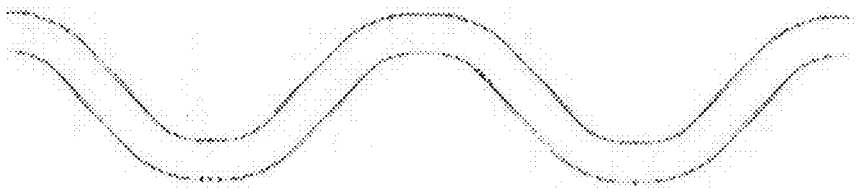
Figure 4:
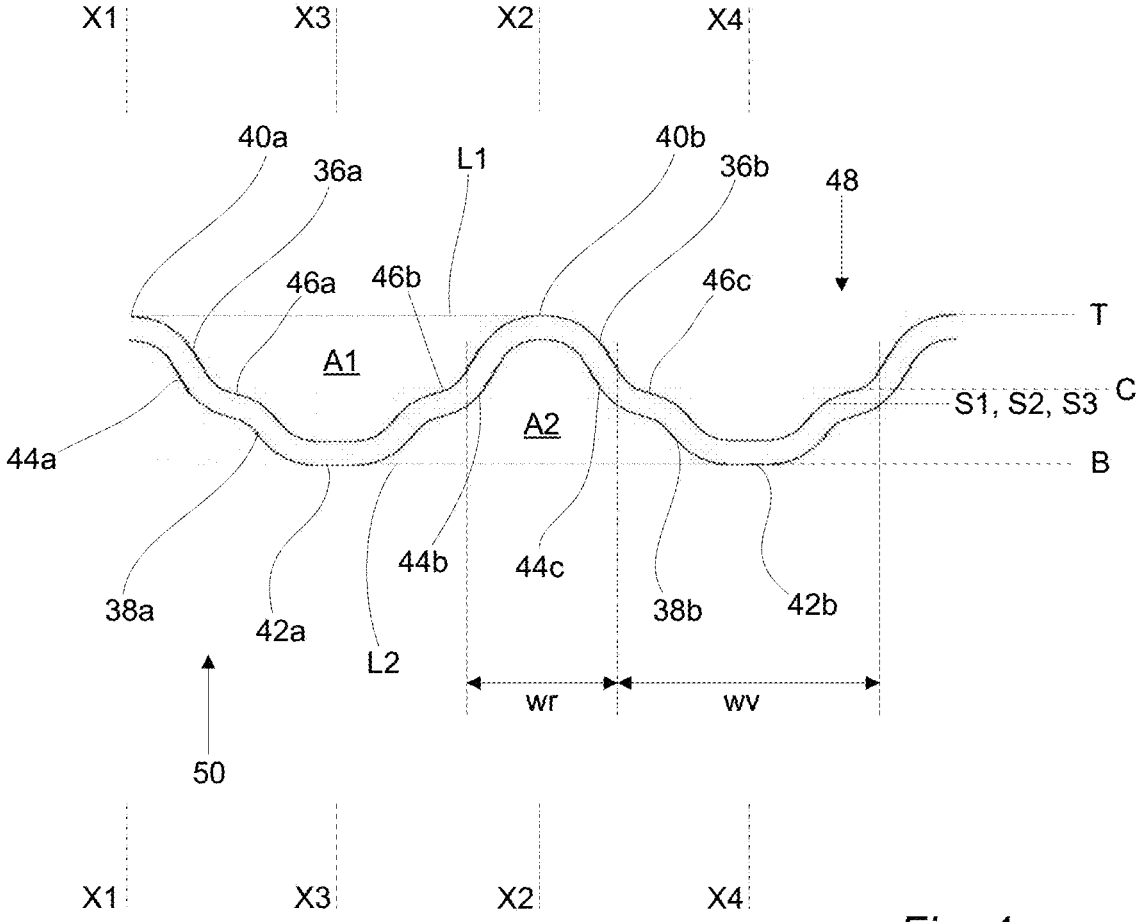

The heat transfer plate 8 will now be further described with reference to FIGS. 2 and 4 which illustrate the complete heat transfer plate and a cross section of the heat transfer plate. The heat transfer plate 8 is an essentially rectangular sheet of stainless steel pressed, in a conventional manner, in a pressing tool, to be given a desired structure. It defines a top plane T, a bottom plane B and a central extension plane C (see also FIG. 1) which are parallel to each other and to the figure plane of FIG. 2. The central extension plane C extends half way between the top and bottom planes, T and B, respectively. The heat transfer plate further has a longitudinal centre axis I and a transverse centre axis t.

The heat transfer plate 8 comprises a first end area 18, a second end area 20 and a heat transfer area 22 arranged there between. In turn, the first end area 18 comprises an inlet port hole 24 for the first fluid and an outlet port hole 26 for the second fluid arranged for communication with the inlet 12 for the first fluid and the outlet for the second fluid, respectively, of the plate heat exchanger 2. Further, the first end area 18 comprises a first distribution area 28 provided with a distribution pattern in the form of a so-called chocolate pattern. Similarly, in turn, the second end area 20 comprises an outlet port hole 30 for the first fluid and an inlet port hole 32 for the second fluid arranged for communication with the outlet 14 of the first fluid and the inlet of the second fluid, respectively, of the plate heat exchanger 2. Further, the second end area 20 comprises a second distribution area 34 provided with a distribution pattern in the form of a so-called chocolate patter. The structures of the first and second end areas are the same but mirror inverted with respect to the transverse centre axis t.

The heat transfer area 22 is provided with a heat transfer pattern in the form of a so-called herringbone pattern. It comprises alternately arranged straight ridges 36 and valleys 38 in relation to the central extension plane C which defines the border between the ridges and valleys. The ridges and valleys extend obliquely in relation to the longitudinal centre axis I of the heat transfer plate 8 and form, pairwise, V-shaped corrugations, the apices of which are arranged along the longitudinal centre axis I of the heat transfer plate 8. FIG. 4 illustrate a cross section through a portion of the heat transfer area taken perpendicular to a longitudinal extension of some of the ridges and valleys 36 and 38, respectively, on one side of the longitudinal centre axis I. In FIG. 4 a first ridge 36*a*, a second ridge 36*b*, a first valley 38*a* and a second valley 38*b* are visible. Hereinafter, the heat transfer pattern will be further described with reference to FIG. 4 and the first and second ridges and valleys. However, across essentially the entire heat transfer area (not immediately close to the border of the heat transfer area and the longitudinal centre axis I of the heat transfer plate), the ridges and valleys have the same cross section, more particularly the cross-section illustrated in FIG. 4, and the following description is thus applicable for all ridges and valleys essentially everywhere within the heat transfer area 22 of the heat transfer plate 8.

The first ridge 36*a* comprises a first top portion 40*a* and the second ridge 36*b* comprises a second top portion 40*b*. The first and second top portions 40*a* and 40*b*, respectively, extend in the top plane T. Further, the first valley 38*a* comprises a first bottom portion 42*a* and the second valley 38*b* comprises a second bottom portion 42*b*. The first and second bottom portions 42*a* and 42*b*, respectively, extend in the bottom plane B.

The first and second ridges 36*a* and 36*b* each have a width wr while the first and second valleys each have a width wv, wr being smaller than wv. The first and second ridges have a respective symmetry axis X1 and X2 extending perpendicularly to the top, bottom and central extension planes and through a respective centre of the first and second top portions, respectively. Similarly, the first and second valleys have a respective symmetry axis X3 and X4 extending perpendicularly to the top, bottom and central extension planes and through a respective centre of the first and second bottom portions, respectively.

The first top portion 40*a* and the first bottom portion 42*a* are connected by a first flank 44*a* which comprises a first shoulder 46*a* at, or extending in, a first shoulder plane S1. The second top portion 40*b* and the first bottom portion 42*a* are connected by a second flank 44*b* which comprises a second shoulder 46*b* at, or extending in, a second shoulder plane S2. The second top portion 40*b* and the second bottom portion 42*b* are connected by a third flank 44*c* which comprises a third shoulder 46*c* at, or extending in, a third shoulder plane S3. As is clear from FIG. 4 the first, second and third shoulder planes S1, S2, S3 coincide which means that the first, second and third shoulders 46*a*, 46*b*, 46*c* are arranged at the same level with respect to the central extension plane C.

The first, second and third shoulder planes S1, S2 and S3 will hereinafter collectively be referred to as the shoulder plane S. The shoulder plane S and thus the first, second and third shoulders are displaced from the central extension plane C, more particularly arranged between the bottom plane B and the central extension plane C.

A front side 48 (visible also in FIG. 2) of the heat transfer plate 8 together with a first shortest imaginary straight line L1 extending from the first top portion 40*a* of the first ridge

36*a* to the second top portion 40*b* of the second ridge 36*b* define a first area A1. Similarly, a back side 50 of the heat transfer plate 8 together with a second shortest imaginary straight line L2 extending from the first bottom portion 42*a* of the first valley 38*a* to the second bottom portion 42*b* of the second valley 38*b* define a second area A2. As a result of the first and second valleys being wider than the first and second ridges, and of the first, second and third shoulders being arranged closer to the bottom plane than the top plane, the first area A1 is larger than the second area A2, which means that the heat transfer pattern is asymmetric.

Figure 5:
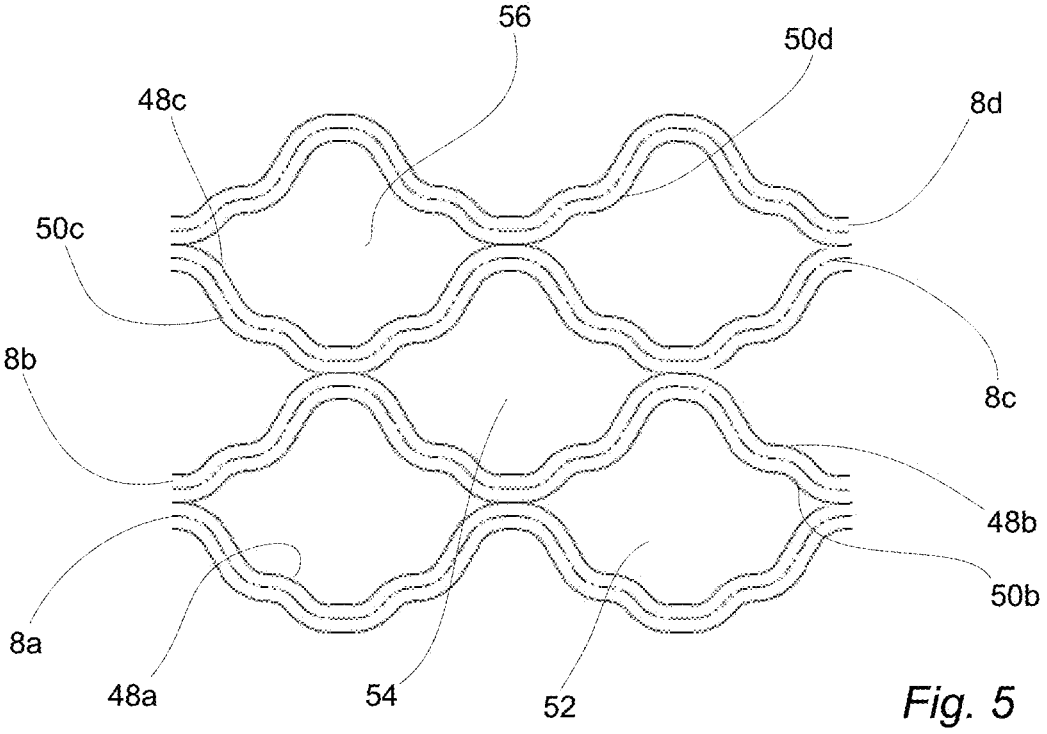
Figure 6:
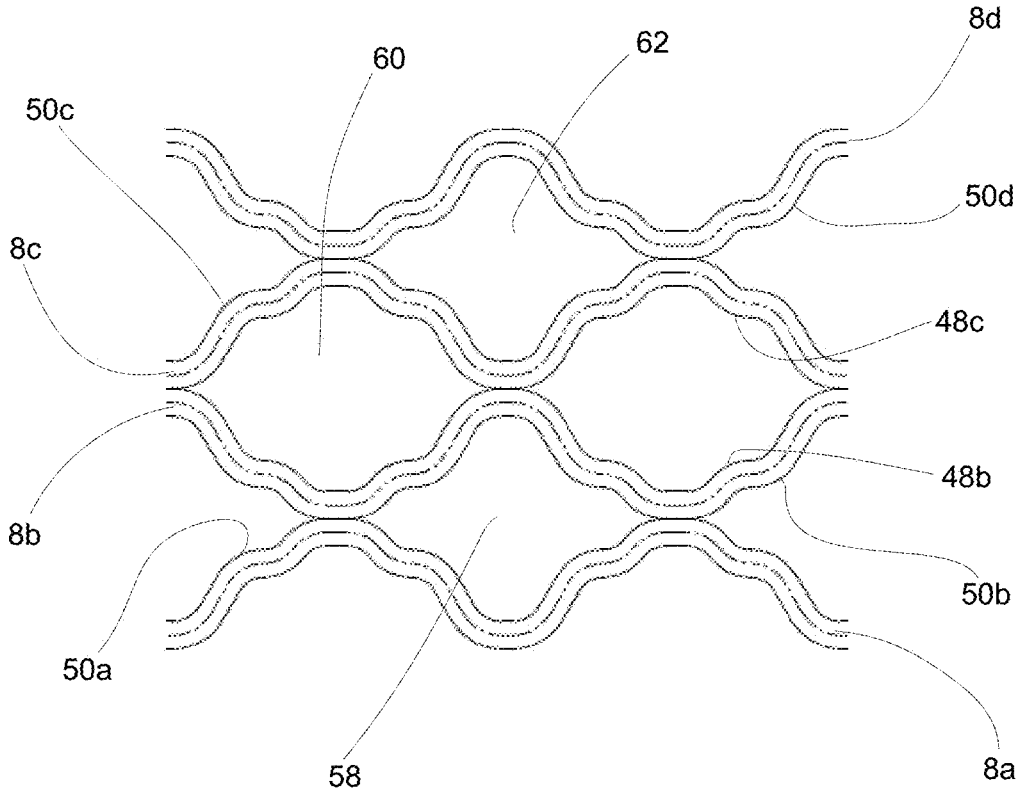

The heat transfer plates 8 may be stacked in two different ways between the first and second end plates 4 and 6, respectively, as is schematically illustrated in FIGS. 5 and 6 for first, second third and fourth heat transfer plates 8*a*, 8*b*, 8*c* and 8*d*, respectively.

With the heat transfer plates stacked as is shown in FIG. 5, a front side 48*a* of the first heat transfer plate 8*a* engages with a back side 50*b* of the second heat transfer plate 8*b*, while a front side 48*b* of the second heat transfer plate 8*b* engages with a back side 50*c* of the third heat transfer plate 8*c*, and a front side 48*c* of the third heat transfer plate engages with a back side 50*d* of the heat transfer plate 8*d*. Throughout the plate pack 10, the valleys 38 and ridges 36 of the heat transfer area 22 of each heat transfer plate engages with the ridges 36 and valleys 38, respectively, of the heat transfer area 22 of the adjacent heat transfer plates. The first and third heat transfer plates 8*a* and 8*c*, respectively, have the same orientation while the second and fourth heat transfer plates 8*b* and 8*d*, respectively, have the same orientation. Further, the second and fourth heat transfer plates are rotated 180 degrees in relation to the first and third heat transfer plates around a respective centre axis c (illustrated in FIG. 2) extending through a respective plate centre and perpendicularly to the central extension plane C (the figure plane of FIG. 2) of the respective heat transfer plate. Arranged like that, the first and second heat transfer plates 8*a* and 8*b* defines a first channel 52 while the second and third heat transfer plates 8*b* and 8*c*, and the third and fourth heat transfer plates 8*c* and 8*d*, define a second channel 54 and a third channel 56, respectively. As is clear from FIG. 5 the first, second and third channels all have the same volume.

Since the ridges and valleys extend obliquely in relation to the longitudinal centre axis of the heat transfer plates, the ridges and valleys of one heat transfer plate will cross and abut the valleys and ridges, respectively, of the adjacent heat transfer plates, and the heat transfer plates will contact each other in separated areas or points within the heat transfer area.

With the heat transfer plates stacked as is shown in FIG. 6, a back side 50*a* of the first heat transfer plate 8*a* engages with a back side 50*b* of the second heat transfer plate 8*b*, while a front side 48*b* of the second heat transfer plate 8*b* engages with a front side 48*c* of the third heat transfer plate 8*c*, and a back side 50*c* of the third heat transfer plate 8*c* engages with a back side 50*d* of the fourth heat transfer plate 8*d*. Throughout the plate pack 10, the ridges 36 and valleys 38 of the heat transfer area 22 of each heat transfer plate engages with the ridges 36 and valleys 38, respectively, of the heat transfer area 22 of the adjacent heat transfer plates. The first and third heat transfer plates 8*a* and 8*c*, respectively, have the same orientation while the second and fourth heat transfer plates 8*b* and 8*d*, respectively, have the same orientation. Further, the second and fourth heat transfer plates are rotated 180 degrees in relation to the first and third heat transfer plates around a respective centre axis c (illustrated in FIG. 2) extending through a respective plate centre and perpendicularly to the central extension plane C (the figure plane of FIG. 2) of the respective heat transfer plate. Arranged like that, the first and second heat transfer plates 8*a* and 8*b* defines a first channel 58 while the second and third heat transfer plates 8*b* and 8*c*, and the third and fourth heat transfer plates 8*c* and 8*d*, define a second channel 60 and a third channel 62, respectively. As is clear from FIG. 5 the first and third channels have the same and a smaller volume than the second channel.

Since the ridges and valleys extend obliquely in relation to the longitudinal centre axis of the heat transfer plates, the ridges and valleys of one heat transfer plate will cross and abut the ridges and valleys, respectively, of the adjacent heat transfer plates, and the heat transfer plates will contact each other in separated areas or points within the heat transfer area.

Thus, with heat transfer plates according to the present invention it is possible to create a plate pack wherein all channels have the same volume, or every second channel has a first volume and the rest of the channels have a second volume, the first and second volumes being different, depending on how the heat transfer plates are stacked. Further, due to the presence of the shoulders between the top and bottom portions of the ridges and valleys, respectively, within the heat transfer pattern of the inventive heat transfer plate, a more turbulent flow and a larger heat transfer area, and thus a more efficient heat transfer, can be obtained within the plate pack.

Naturally, the measures of the inventive heat transfer plate may be varied in a countless number of ways and the volume of the channel between two adjacent inventive heat transfer plates is dependent on these measures. As a non-limiting example, a plurality of heat transfer plates according to FIG. 4, when stacked as illustrated in FIG. 5, define a channel volume V, and when stacked as illustrated in FIG. 6, define channel volumes Vsmall and Vlarge, where Vlarge=1.15×V and Vsmall=0.85×V.

The above described embodiments of the present invention should only be seen as examples. A person skilled in the art realizes that the embodiments discussed can be varied and combined in a number of ways without deviating from the inventive conception.

As an example, the above specified distribution pattern of chocolate type and heat transfer pattern of herring bone type are just exemplary. Naturally, the invention is applicable in connection with other types of patterns. For example, the heat transfer pattern could comprise V-shaped corrugations wherein the apex of each corrugation points from one long side towards another long side of the heat transfer plate, perpendicularly or non-perpendicularly with respect to the long sides.

Further, in the above described embodiments essentially all the ridges, valleys, flanks and shoulders of the heat transfer pattern of the heat transfer plate are similar or mirror images of each other, but they may differ from each other in alternative embodiments of the invention. For example, according to an alternative embodiment, not all flanks are provided with a shoulder.

Moreover, in the above described embodiments the ridges are more narrow than the valleys but in alternative embodiments it may be the other way around, or the ridges and the valleys may be of the same width.

The flanks of the above described heat transfer pattern comprise one shoulder each and the shoulders are equally positioned on each flank. Variations are possible. For example, some or each flank may comprise more than one shoulder and/or the shoulders may be differently positioned between the flanks. Further, the shoulders may extend in other shoulder planes than the above described ones, also shoulder planes arranged between the central extension plane and the top plane of the heat transfer plate.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

The plate heat changer above comprises one plate type only. Naturally, the plate heat exchanger could instead comprise two or more different types of alternately arranged heat transfer plates. Further, the heat transfer plates could be made of other materials than stainless steel.

The present invention could be used in connection with other types of plate heat exchangers than gasketed ones, such as all-welded, semi-welded and brazed plate heat exchangers.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate having opposite ends and a longitudinal centre axis that intersects the opposite ends of the heat transfer plate, the heat transfer plate defining a top plane, a bottom plane and a central extension plane extending half way between the top and bottom planes, the central extension plane extending parallel to the longitudinal centre axis as well as the top and bottom planes, the heat transfer plate comprising a heat transfer area comprising a heat transfer pattern of alternately arranged ridges and valleys in relation to the central extension plane, first and second adjacent ones of the ridges extending obliquely in relation to the longitudinal centre axis of the heat transfer plate as seen in plan view of the heal transfer plate and comprising a first top portion and a second top portion, respectively, and first and second adjacent ones of the valleys extending obliquely in relation to the longitudinal centre axis of the heat transfer plate as seen in the plan view of the heat transfer plate and comprising a first bottom portion and a second bottom portion, respectively, the first valley being arranged between the first and second ridges and the second ridge being arranged between the first and second valleys, the first bottom portion of the first valley being connected to the first top portion of the first ridge by a first flank and to the second top portion of the second ridge by a second flank, and the second top portion of the second ridge being connected to the second bottom portion of the second valley by a third flank, the first and second top portions extending in the top plane and the first and second bottom portions extending in the bottom plane, one of the first, second and third flanks comprising a shoulder extending in a shoulder plane which is displaced from the central extension plane, and, with reference to a cross section through, and perpendicular to a longitudinal extension of, the first and second ridges and the first and second valleys, a first area enclosed by the heat transfer plate and a first shortest imaginary straight line extending from the first to the second top portion of the first ridge and the second ridge, respectively, is different from a second area enclosed by the heat transfer plate and a second shortest imaginary straight line extending from the first to the second bottom portion of the first valley and the second valley, respectively.

2. A heat transfer plate according to claim 1, wherein the shoulder is one of three shoulders that include the one shoulder and two other shoulders, the one of the three shoulders extending in the shoulder plane, each of the other two shoulders extending in a respective shoulder plane, each of the first, second and third flanks comprising a respective one of the three shoulders.

3. A heat transfer plate according to claim 2, wherein the shoulder plane in which the one of the three shoulders extends is displaced from the central extension plane, and the shoulder panes in which the other two shoulders extend are displaced from the central extension plane.

4. A heat transfer plate according to claim 2, wherein the shoulder plane in which the one of the three shoulders extends and the shoulder planes in which the other two shoulders extend coincide with one another.

5. A heat transfer plate according to claim 2, wherein the shoulder plane in which the one of the three shoulders extends and the shoulder planes in which the other two shoulders extend extend between the bottom plane and the central extension plane.

6. A heat transfer plate according to claim 2, wherein the first, second and third flanks each comprise one shoulder only.

7. A heat transfer plate according to claim 1, wherein, with reference to said cross section, the first and second ridges are uniform.

8. A heat transfer plate according to claim 1, wherein, with reference to said cross section, the first and second valleys are uniform.

9. A heat transfer plate according to claim 1, wherein, with reference to said cross section, the first and third flanks are uniform.

10. A heat transfer plate according to claim 1, wherein, with reference to said cross section, the second flank is a mirroring of the first and third flanks.

11. A heat transfer plate according to claim 1, wherein, with reference to said cross section, the first valley is wider than the first ridge.

12. A heat exchanger comprising a plurality of heat transfer plates according to claim 1, wherein a front side of a first one of the heat transfer plates faces a back side of a second one of the heat transfer plates, a front side of the second heat transfer plate faces a back side of a third one of the heat transfer plates, and the second heat transfer plate is rotated 180 degrees in relation to the first and third heat transfer plates around a centre axis of the second heat transfer plate extending through a centre, and perpendicularly to the central extension plane, of the second heat transfer plate.

13. A heat exchanger according to claim 12, wherein the valleys of the heat transfer pattern of the second heat transfer plate abuts the ridges of the heat transfer pattern of the first heat transfer plate to define a first channel, and the ridges of the heat transfer pattern of the second heat transfer plate abuts the valleys of the heat transfer pattern of the third heat transfer plate to define a second channel, the first and second channels having essentially the same volume.

14. A heat exchanger comprising a plurality of heat transfer plates according to claim 1, wherein a back side of a first one of the heat transfer plates faces a back side of a second one of the heat transfer plates, a front side of the second heat transfer plate faces a front side of a third one of the heat transfer plates, and the second heat transfer plate is rotated 180 degrees in relation to the first and third heat transfer plates around a centre axis of the second heat transfer plate extending through a centre, and perpendicularly to the central extension plane, of the second heat transfer plate.

15. A heat exchanger according to claim 14, wherein the valleys of the heat transfer pattern of the second heat transfer plate abut the valleys of the heat transfer pattern of the first heat transfer plate to define a first channel, and the ridges of the heat transfer pattern of the second heat transfer plate abut the ridges of the heat transfer pattern of the third heat transfer plate to define a second channel, the first and second channels having different volumes.

16. A heat transfer plate having opposite ends and a longitudinal centre axis that intersects the opposite ends of the heat transfer plates, the heat transfer plate defining a top plane, a bottom plane and a central extension plane extending half way between the top and bottom planes, the central extension plane extending parallel to the longitudinal centre axis, the heat transfer plate comprising first and second end areas at the opposite ends of the heat transfer plate and a heat transfer area positioned between the first and second end areas, the heat transfer area comprising a heat transfer pattern of alternately arranged ridges and valleys in relation to the central extension plane, the ridges and valleys each having opposite ends and extending over a longitudinal extent between the opposite ends, first and second adjacent ones of the ridges extending obliquely in relation to the longitudinal centre axis of the heat transfer plate so that the longitudinal extent of the first and second adjacent ones of the ridges extend obliquely in relation to the longitudinal centre axis of the heat transfer plate as seen in plan view of the heat transfer plate, the first and second adjacent ones of the ridges comprising a first top portion and a second top portion, respectively, and first and second adjacent ones of the valleys extending obliquely in relation to the longitudinal centre axis of the heat transfer plate so that the longitudinal extent of the first and second adjacent ones of the valleys extend obliquely in relation to the longitudinal centre axis of the heat transfer plate as seen in plan view of the heat transfer plate, the first and second adjacent ones of the valleys comprising a first bottom portion and a second bottom portion, respectively, the first valley being arranged between the first and second ridges and the second ridge being arranged between the first and second valleys, the first bottom portion of the first valley being connected to the first top portion of the first ridge by a first flank and to the second top portion of the second ridge by a second flank, and the second top portion of the second ridge being connected to the second bottom portion of the second valley by a third flank, the first and second top portions extending in the top plane and the first and second bottom portions extending in the bottom plane, one of the first, second and third flanks comprising a shoulder extending in a shoulder plane which is displaced from the central extension plane, and, with reference to a cross section through, and perpendicular to a longitudinal extension of, the first and second ridges and the first and second valleys, a first area enclosed by the heat transfer plate and a first shortest imaginary straight line extending from the first to the second top portion of the first ridge and the second ridge, respectively, is different from a second area enclosed by the heat transfer plate and a second shortest imaginary straight line extending from the first to the second bottom portion of the first valley and the second valley, respectively.

17. A heat transfer plate according to claim 16, further comprising two port holes passing through the heat transfer plate and positioned in the first end area of the heat transfer plate, and two other port holes passing through the heat transfer plate and positioned in the second end area of the heat transfer plate, the longitudinal centre axis of the heat transfer plate passing between the two port holes positioned in the first end area of the heat transfer plate so that the longitudinal centre axis of the heat transfer plate is spaced from the two port holes positioned in the first end area of the heat transfer plate, the longitudinal centre axis of the heat transfer plate passing between the two other port other holes positioned in the second end area of the heat transfer plate so that the longitudinal centre axis of the heat transfer plate is spaced from the two other port holes positioned in the second end area of the heat transfer plate.

18. A heat transfer plate according to claim 16, wherein the alternately arranged ridges and valleys form pairwise a plurality of V-shaped corrugations each having an apex, the apex of each of at least some of the plurality of V-shaped corrugations being positioned along the longitudinal centre axis of the heat transfer plate.

19. A heat transfer plate having opposite ends and a longitudinal centre axis that intersects the opposite ends of the heat transfer plates, the heat transfer plate defining a top plane, a bottom plane and a central extension plane extending half way between the top and bottom planes, the central extension plane extending parallel to the longitudinal centre axis, the heat transfer plate comprising a heat transfer area comprising a heat transfer pattern of alternately arranged ridges and valleys in relation to the central extension plane, first and second adjacent ones of the ridges being straight ridges that are straight as seen in plan view of the heat transfer plate and that extend obliquely in relation to the longitudinal centre axis of the heat transfer plate as seen in the plan view of the heat transfer plate, the first ridge comprising a first top portion and the second ridge comprising a second top portion, first and second adjacent ones of the valleys being straight valleys that are straight as seen in the plan view of the heat transfer plate and that extend obliquely in relation to the longitudinal centre axis of the heat transfer plate as seen in the plan view of the heat transfer plate, the first valley comprising a first bottom portion and the second valley comprising a second bottom portion, the first valley being arranged between the first and second ridges and the second ridge being arranged between the first and second valleys, the first bottom portion of the first valley being connected to the first top portion of the first ridge by a first flank and to the second top portion of the second ridge by a second flank, and the second top portion of the second ridge being connected to the second bottom portion of the second valley by a third flank, the first and second top portions extending in the top plane and the first and second bottom portions extending in the bottom plane, one of the first, second and third flanks comprising a shoulder extending in a shoulder plane which is displaced from the central extension plane, and, with reference to a cross section through, and perpendicular to a longitudinal extension of, the first and second ridges and the first and second valleys, a first area enclosed by the heat transfer plate and a first shortest imaginary straight line extending from the first to the second top portion of the first ridge and the second ridge, respectively, is different from a second area enclosed by the heat transfer plate and a second shortest imaginary straight line extending from the first to the second bottom portion of the first valley and the second valley, respectively.

20. A heat transfer plate according to claim 19, wherein the one of the first, second and third flanks that comprises the shoulder is the second flank, the shoulder plane being one shoulder plane, the third flank also comprising a shoulder extending in an other shoulder plane which is displaced from the central extension plane, the one shoulder plane and the other shoulder plane being positioned between the central extension plane and the bottom plane.

* * * * *